US005922236A

United States Patent [19]

Zuhl

[11] Patent Number: 5,922,236

[45] Date of Patent: Jul. 13, 1999

[54] MODULAR FORMING SYSTEM FOR FORMING CONCRETE FOUNDATION WALLS

[76] Inventor: David M. Zuhl, 1848 Townline, Benton Harbor, Mich. 49022

[21] Appl. No.: 08/831,140

[22] Filed: Apr. 1, 1997

[51] Int. Cl.[6] ..... E04G 17/12

[52] U.S. Cl. ..... 249/34; 249/40; 249/44; 249/47; 249/216

[58] Field of Search ..... 249/40, 44, 47, 249/190, 192, 194, 196, 213, 216, 34

[56] References Cited

U.S. PATENT DOCUMENTS

| | | | |
|---|---|---|---|
| 4,147,322 | 4/1979 | Dahlstrom | 249/40 |
| 4,678,156 | 7/1987 | Scalamandre et al. | 249/34 |
| 4,915,345 | 4/1990 | Lehmann | 249/18 |
| 4,916,870 | 4/1990 | Boeshart | 249/40 X |
| 5,039,059 | 8/1991 | Miller | 249/196 |
| 5,080,321 | 1/1992 | Carlson | 249/196 |
| 5,160,640 | 11/1992 | Badstieber | 249/189 |
| 5,209,039 | 5/1993 | Boeshart | 249/40 X |
| 5,431,368 | 7/1995 | Wilde | 249/213 |
| 5,456,444 | 10/1995 | Wegman | 249/40 |
| 5,511,761 | 4/1996 | Schultz | 249/40 X |
| 5,658,483 | 8/1997 | Boeshart | 249/191 |

*Primary Examiner*—Beth Aubrey
*Attorney, Agent, or Firm*—Baker & Daniels

[57] ABSTRACT

A modular forming unit for forming concrete foundation walls having a footing of rectangular cross-section includes a pair of spaced apart form members that are connected by a plurality of stabilizing spacers. The stabilizing spacers permit each complete wall forming unit to be prefabricated to precise dimensions off-site and then transported to the job site. Each pre-fabricated wall form section can then be put in place as a single unit, so that no on ground or below ground assembly is required.

5 Claims, 6 Drawing Sheets

MODULAR FORMING SYSTEM FOR FORMING CONCRETE FOUNDATION WALLS

The present invention relates generally to a wall forming apparatus for use in residential and/or commercial construction that allows footings and foundation walls to be poured at the same time.

BACKGROUND OF THE INVENTION

Many residential and light commercial structures are built on concrete foundation walls which are formed by pouring concrete into a system of forms that have been erected in an excavated trench. After the concrete has cured sufficiently, the forms are stripped from the concrete and the trench is filled around the wall. Typically, the base of each foundation wall is supported on a concrete footing, which is slightly wider than the thickness of the wall itself. Ideally, the centerline of the wall is aligned with the centerline of the footing. The footing spreads the load of the structure over a greater area and prevents uneven settling of the foundation.

In the past, the footing at the base of the wall was poured before the wall was poured. The forms for the footing were erected, and concrete was poured in the form. After the concrete footing had sufficiently cured, the forms for the footings were stripped and removed, and separate wall forms were erected. After the wall section had been poured and cured, the wall forms were removed and the foundation wall is complete.

Typically, each of the form sections are pre-treated with an oil based releasing agent prior to pouring the concrete, which makes it much easier to strip and remove the forms from the cured concrete. Unfortunately, the releasing agents frequently contaminate the top surface of the footing section, thus preventing the later poured wall section from bonding properly to the footing. As a result, some portions of the foundation wall are weaker than other portions, and the foundation wall is more likely to leak and is more prone to cracking and uneven settling. Accordingly, modular form systems have been developed that allow the footing and the wall to be poured simultaneously.

The combination footing/wall form systems presently available suffer from a number of inherent drawbacks. First, in order for the combined footing/wall forms to be labor efficient, the footing form and the wall form must be connected into a panel, and then each panel must be connected to an opposing panel by a series of cross ties in order to form the concrete receiving cavity in between the panels. The prior art opposing panels must be connected to each other after the panels have been placed in the trench, which offers little space for the workers to maneuver. Another drawback with these combination from systems is that, due to hydrostatic pressure, the form is likely to lift off the ground when the concrete is poured. Accordingly, either the form must be secured to the ground with ground screws to anchor the form or the top of the footing section must be sloped. Ground screws are difficult and time consuming to install, and sloped footings violate most local building codes.

An improved modular wall forming system according to the present invention allows the footing and wall to be poured simultaneously, and permits the formation of a footing with a flat top surface which meets most local codes. The modular wall forming system according to the present invention allows two opposing spaced apart wall forming members to be pre-assembled and put in place as a single unit, so that each complete unit need only be connected to an adjacent unit prior to pouring the concrete. The modular wall forming system of the present invention does not require labor intensive ground anchors and will not sink into the ground.

SUMMARY OF THE INVENTION

The modular wall forming system of the present invention enables two opposing spaced apart form sections to be connected together off-site and then transported and put in place as a single unit. The cross ties that connect the opposing panels together incorporate a stabilizing structure that prevents relative movement between the opposing form sections, and which allows the modular form units to be transported and installed without the connected panels shifting out of alignment. The novel stabilizing structure also cooperates with reinforcing ribs on the panel sections to stiffen each section, which substantially reduces the number of cross ties required. The stabilizing structure further enables each panel to be much longer than any prior art panels. Forms as long as 96 inches having been successfully fabricated and used.

Each panel also includes a lip or flange extending from its lower edge which enables the installer to place backfill or ballast to anchor the form units without ground anchors. The resulting footing structure is rectangular in accordance with most local codes, and yet the forms can subsequently be stripped and removed without removing the ballast. The present modular forms system also offers much greater flexibility in forming corners and other foundation features, such as supports for fireplaces or other applications which must support heavy point loads.

Accordingly, it is an object of this invention to provide a modular wall forming system for forming foundation walls and footings simultaneously.

Another object of this invention is to provide a modular wall forming system that allows two opposing panels to be connected off-site and then transported and installed as a unit.

Still another object of this invention is to provide a modular wall forming system that maintains the two opposing form panels in precise alignment with each other and secured against relative movement.

A further object of this invention is to provide a modular wall forming system that forms rectangular footings and that does not require labor intensive ground anchors.

These and other objects of the invention will become evident upon a reading of the following detailed description.

DETAILED DESCRIPTION OF THE INVENTION

Figure 1:
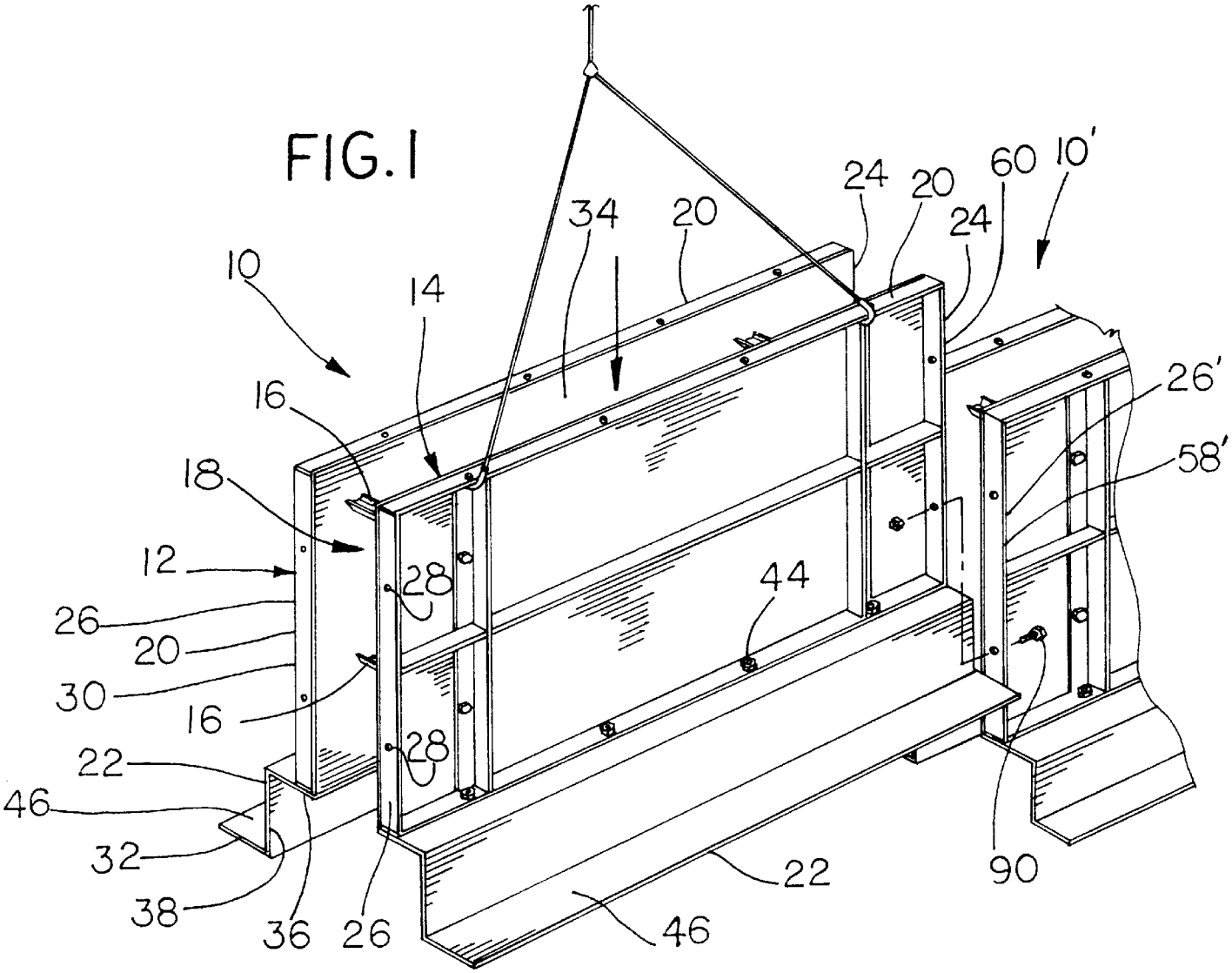
FIG. 1 is a perspective view of a modular concrete wall form unit according to the present invention shown being installed adjacent to a similar unit in preparation for pouring concrete into the form system.

The embodiment herein described is not intended to be exhaustive or to limit the invention to the precise form disclosed. It has been chosen and described in order to explain the principles of the invention as well as its application and practical use to best enable others skilled in the art to follow its teachings.

Referring now to the drawings, a modular form unit having the features of the present invention is generally indicated by the reference numeral 10. Unit 10 includes a pair of generally symmetrical spaced apart members 12, 14 which are spaced apart by a plurality of stabilizing spacers 16 to define a concrete receiving cavity 18 between the members. Each of the members 12, 14 includes an upper edge 20, a lower edge 22, and a pair of side edges 24, 26. Side edges 24, 26 include a plurality of bolt holes 28 to permit edges 24, 26 to be attached to a similar adjacent form unit 10'.

Figure 2:
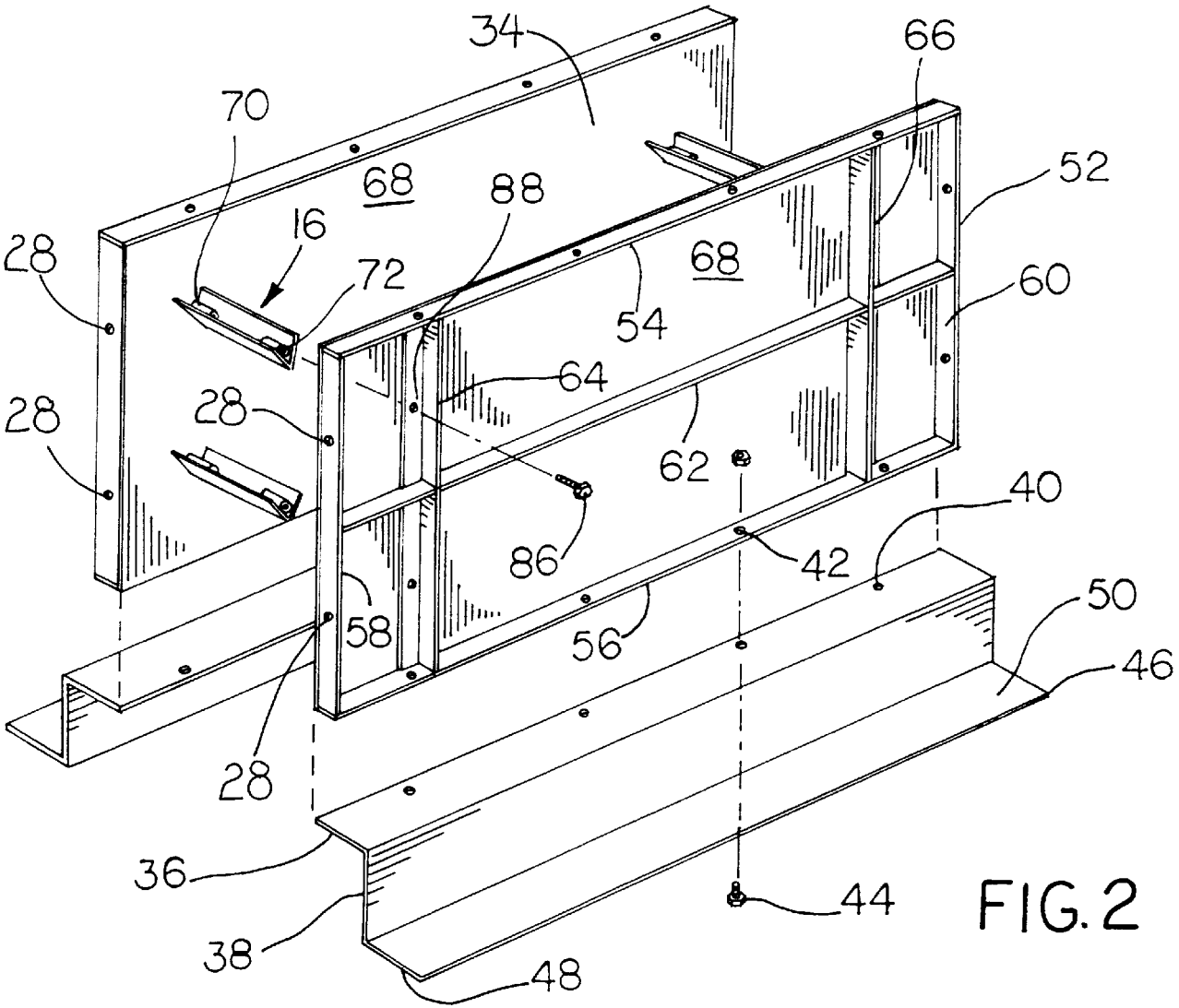
FIG. 2 is an exploded view in perspective of the modular concrete form unit shown in FIG. 1.

As shown in FIGS. 1 and 2, each member 12, 14 includes a wall forming section 30 and a footing forming section 32. Wall section 30 includes a planar concrete forming surface 34, while footing section 32 includes an upper forming surface 36 and a lower forming surface 38. Surface 34 is preferably perpendicular to surface 36, and surface 36 is preferably perpendicular to surface 38. Upper surface 36 of footing section 32 includes a plurality of bolt holes 40 which register with bolt holes 42 on the lower edge of wall section 30 to permit wall section 30 and footing section 32 to be bolted together using a plurality of attachment bolts 44. Lower edge 22 of each member 12, 14 includes a ground panel 46 which extends outwardly away from and perpendicular to surface 38. Ground panel 46 includes a bottom surface 48 for placement on a support surface such as the ground, and also includes a top surface 50 for receiving sand, backfill or other ballast.

As shown in FIG. 2, the wall forming section 30 of each member 12, 14 includes a frame 52. Frame 52 includes upper and lower ribs 54, 56 and a pair of side ribs 58, 60. A horizontally extending reinforcing rib 62 extends from rib 58 to rib 60, while a pair of vertically extending reinforcing ribs 64, 66 extend between ribs 54 and 56. A wall panel 68, which is preferably a steel plate, is welded or otherwise secured to frame 52.

Figure 3A:
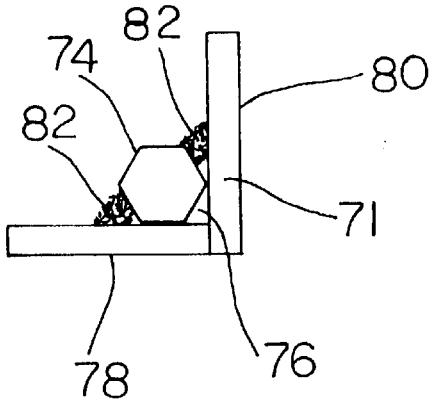
FIG. 3A is a cross-sectional view of the stabilizing spacer taken substantially along lines 3A—3A of FIG. 3.
Figure 3:
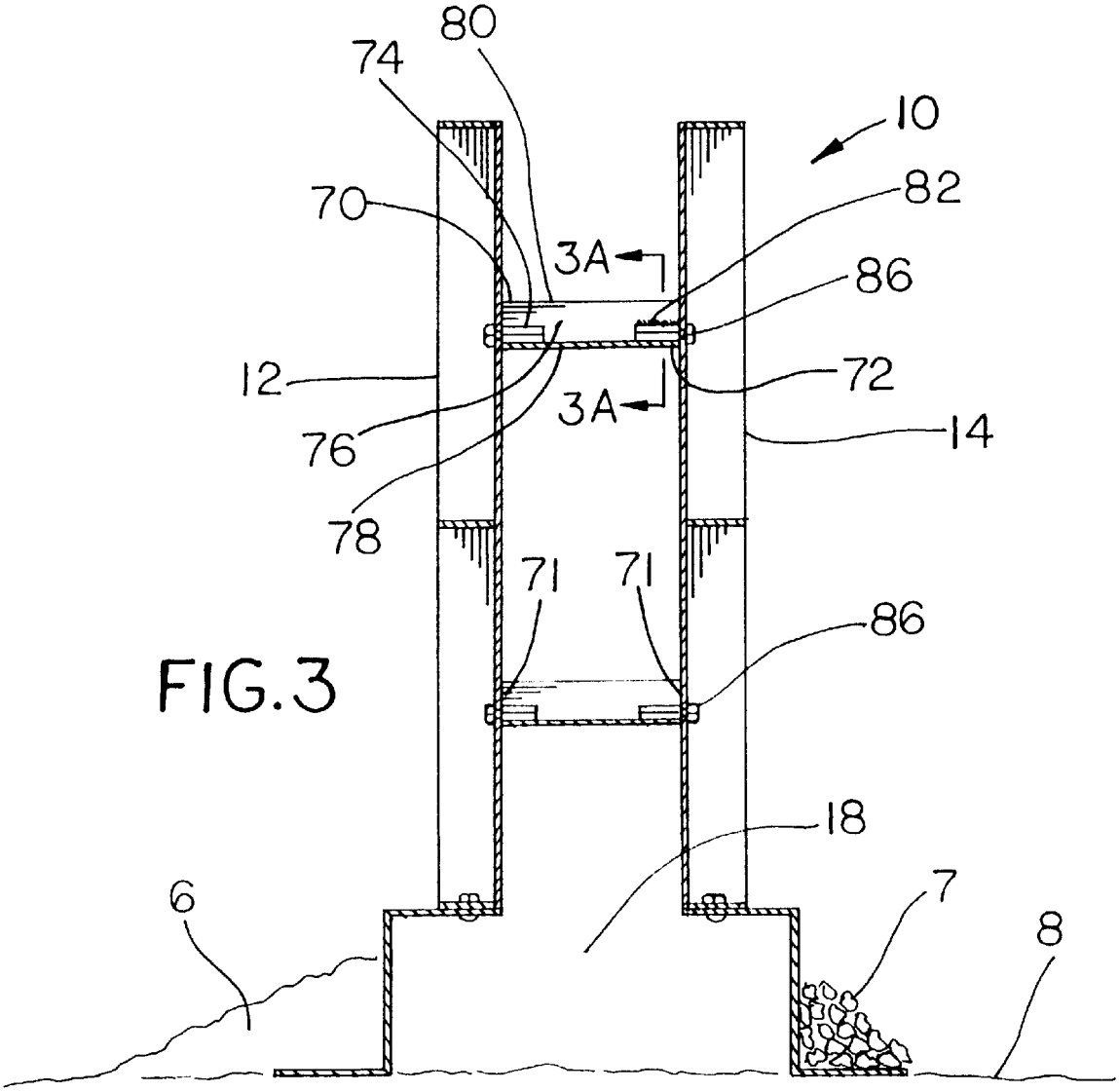
FIG. 3 is a cross-sectional view of the modular concrete form unit shown in FIGS. 1 and 2 taken substantially along lines 3—3 of FIG. 1.

As shown in FIGS. 2 and 3*a*, each stabilizing spacer 16 includes a pair of ends 70, 72. Spacers 16 have a generally L shaped or V shaped cross section formed from the intersection of legs 78, 80. Each spacer 16 is preferably fabricated from an angled section of steel. Accordingly, each end 70, 72 forms an L shaped transverse surface 71. Each end 70, 72 includes an elongated, threaded nut 74 which is welded or otherwise secured to spacer 16 at the inside corner 76 of legs 78, 80 by a pair of elongated fillet welds 82. As shown in FIGS. 2 and 3, each spacer is secured in place by an attachment bolt 86 threaded into a corresponding threaded nut 74. Each bolt 86 extends through a corresponding one of a plurality of holes 88 in ribs 64 or 66 of frame 52. Accordingly, the transverse surface 71 of each end 70, 72 of spacers 16 abuts the planar surface of panel 68, thus maintaining spacers 16 in a position perpendicular to panel 68 at all times. Further, mounting the spacer 16 so that the bolts 86 intersect the vertical reinforcing ribs as shown in FIG. 2 allows frame 52 to further stiffen panel 68. Bolts 86 hold spacers 16 against the concrete forming surface 30 so that the generally perpendicular legs of transverse surfaces 71 prevent each spacer 16 from moving relative to the concrete forming surface 34. Accordingly, spacers 16 prevent any relative movement between members 12 and 14.

Figure 6:
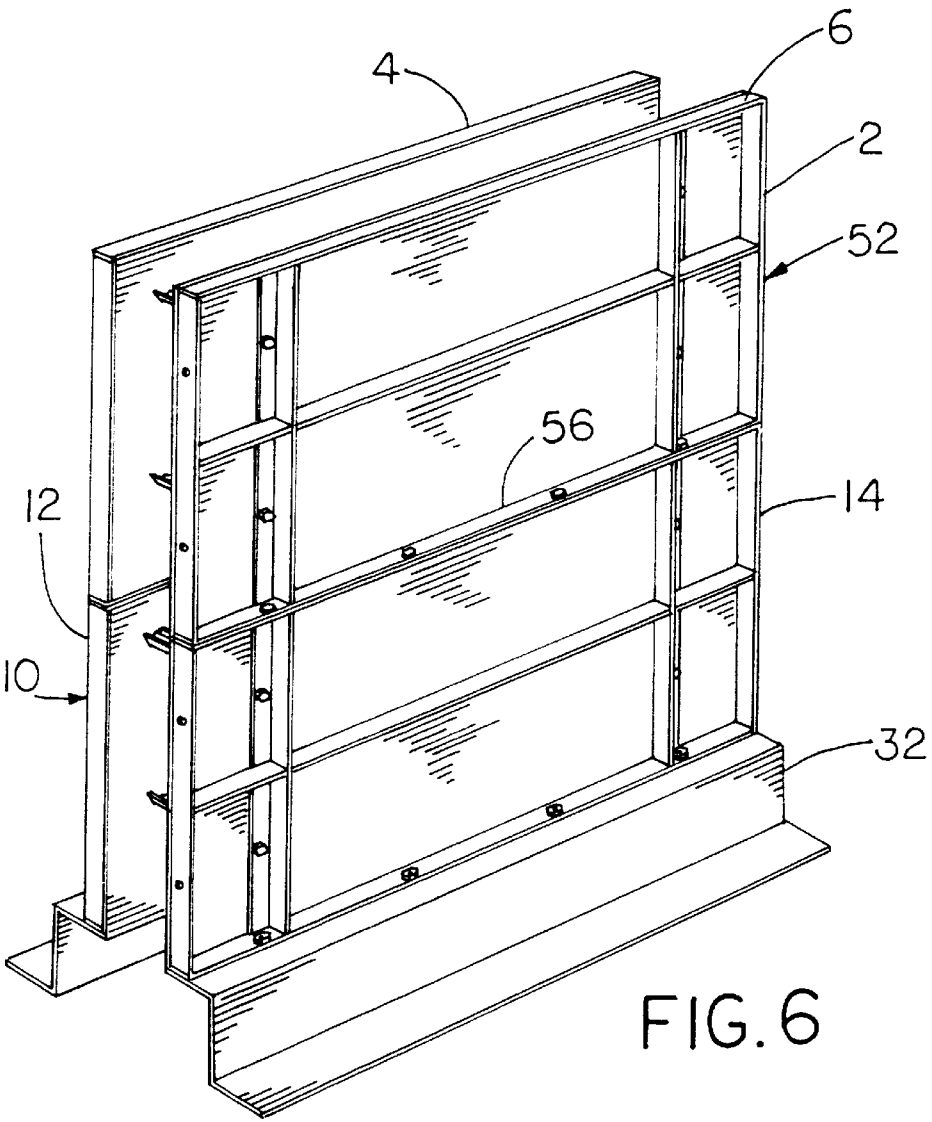
FIG. 6 is a perspective view of the modular form unit shown in FIGS. 1 through 3 shown with an auxiliary section attached to the top portion for forming a relatively tall concrete wall.

In operation, each member 12, 14 is assembled in the manner shown in FIG. 2 by connecting footing section 32 to wall section 30 using a plurality of bolts 44 through holes 40 and 42. Members 12 and 14 are then connected together using the stabilizing spacers 16 which are secured in place using bolts 86 through holes 88 threaded into elongated nut 74. As shown in FIG. 1, the completed unit 10 is lowered into place using a lift mechanism (not shown) such as a backhoe, a small crane, or other means. The unit 10 is then secured to an adjacent unit 10' using a plurality of bolts 90 to connect edge 24 of unit 10 to edge 26' of unit 10'. As shown in FIG. 3, unit 10 is held in place on the support surface or ground 8 by placing either sand 6 or gravel 7 ballast on the upper surface 50 of ground panel 46. Ballast 6 or 7 prevents unit 10 from lifting off of the ground 8 due to hydrostatic pressure created when liquid concrete is poured into cavity 18. As shown in FIG. 6, for applications in which the concrete wall is relatively tall, an upper unit 2 having a pair of members 3 and 4 can be prepared. Upper unit 2 is similar in construction to unit 10, but lacks the footing section 32 normally attached to the lower edge 56 of frame 52.

Figure 4:
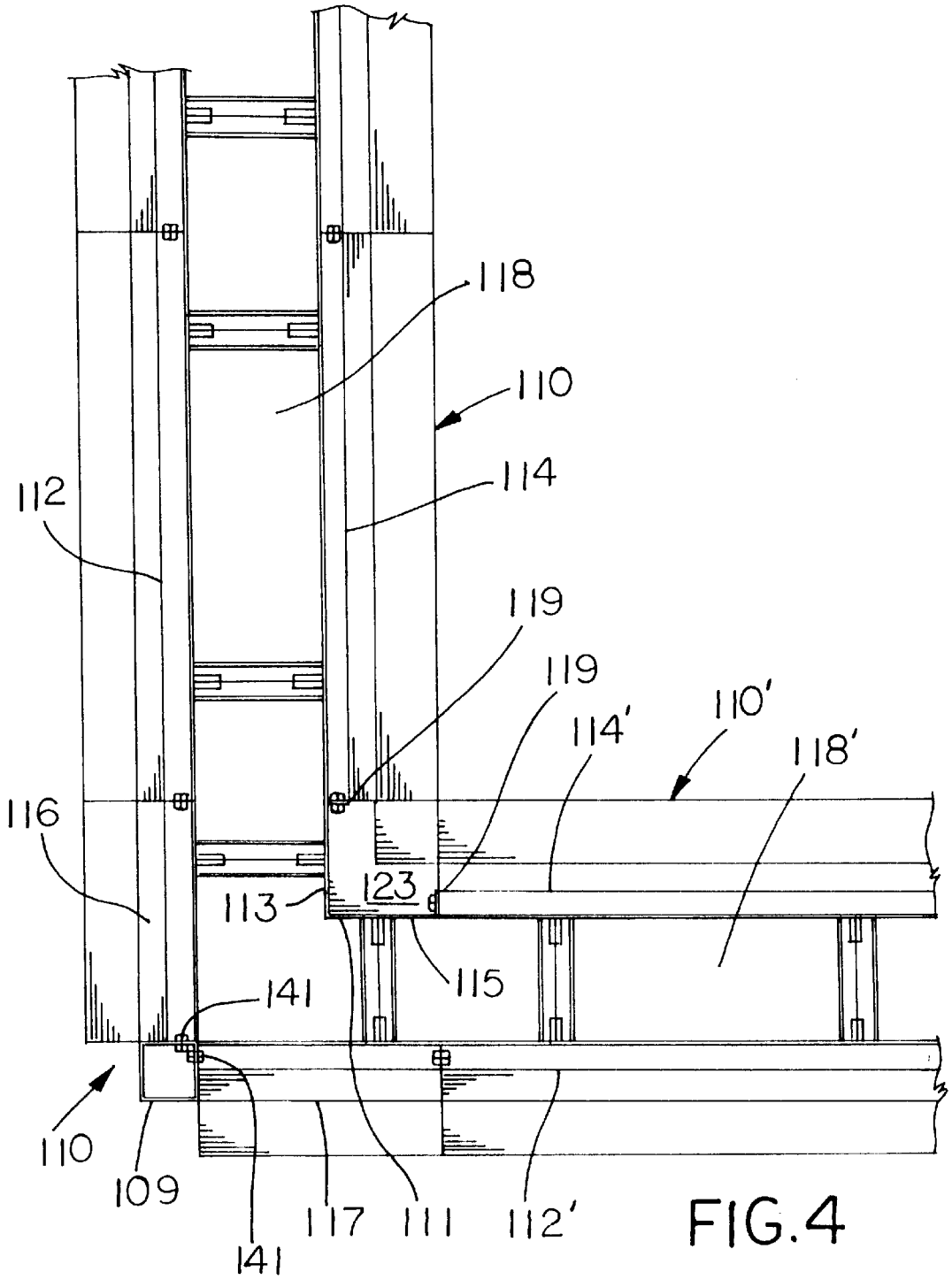
FIG. 4 is a top plan view of a modular corner unit for use in conjunction with two of the modular units shown in FIGS. 1 through 3 to form the corner of a wall.
Figure 5:
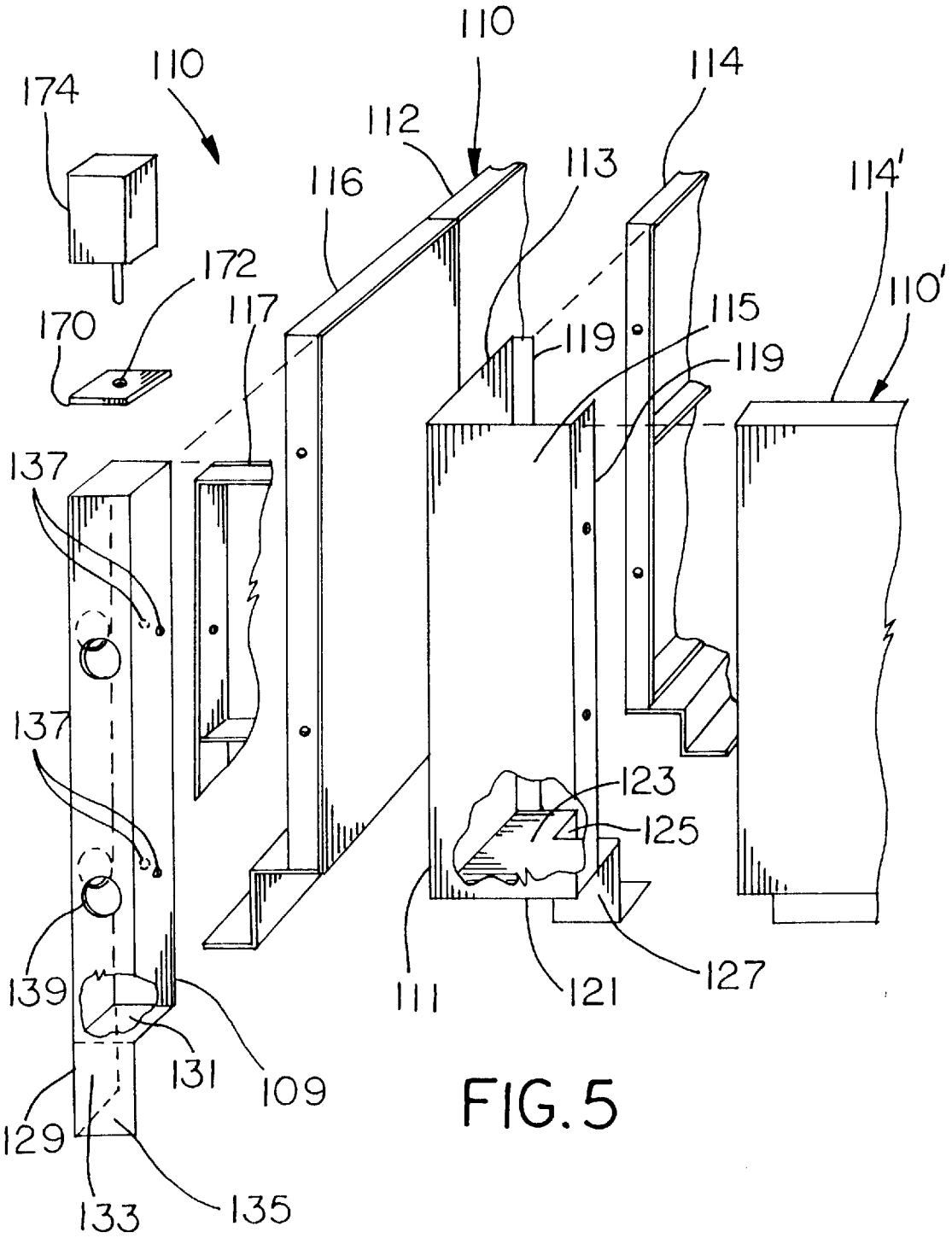
FIG. 5 is an fragmentary exploded view in perspective of the modular corner unit shown in FIG. 4.
Figure 5A:
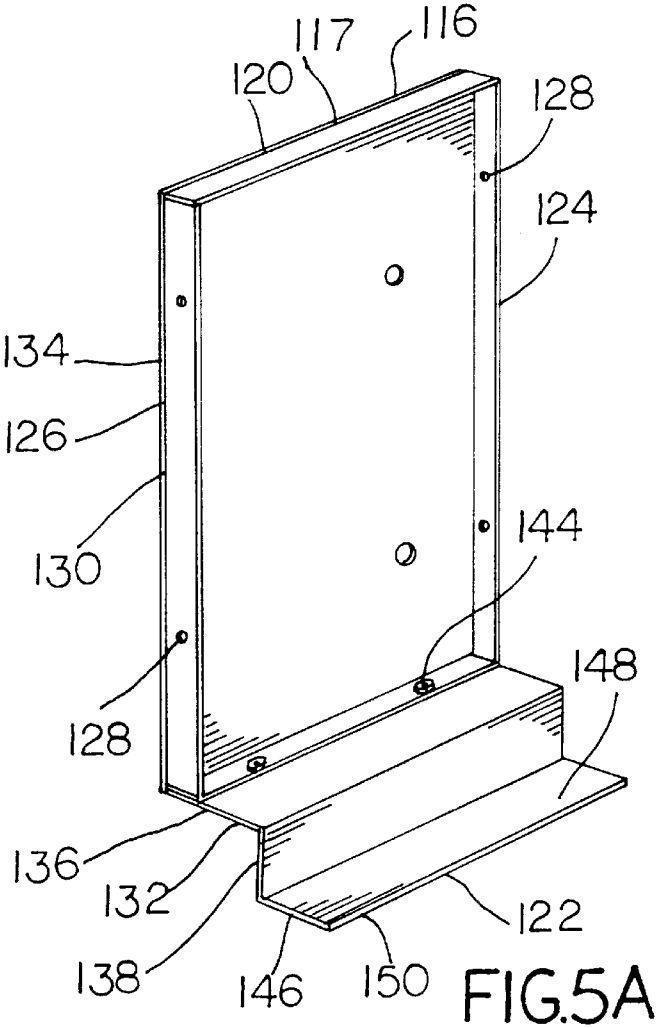
FIG. 5A is a perspective view of the extender panels for use with the modular corner unit shown in FIGS. 4 and 5.

FIGS. 4, 5 and 5*a* illustrate a second embodiment for the wall forming system, in which elements that are substantially the same as those described above for the embodiment of FIGS. 1 through 3*a* retain the same reference characters, but increased by 100. As shown in FIG. 4, a corner unit is generally referred to by the reference numeral 102. Corner unit 102 is shown attached to two standard units 10 and 10', which are disposed at right angles relative to each other. Accordingly, corner unit 102 is used to form the corner of a foundation wall by forming a cavity 118 having a ninety degree bend. Corner unit 102 includes an inner post 111 and an outer post 109. Inner post 111 connects member 14 of unit 10 to member 14' of unit 10. Accordingly, inner post 111 defines the inside corner of the cavity 118. Similarly, outer post 109 connects member 112 of unit 110 to member 112' of unit 10' using a pair of extenders 116, 117. Extender 116 connects outer post 109 to member 112 of unit 110, while extender 117 connects outer post 109 to member 112' of unit 110' Accordingly, outer post 109 forms the outer corner of the cavity 118.

As shown in FIGS. 4 and 5, inner post 111 includes a pair of wall forming surfaces 113, 115 that are preferably perpendicular to each other. Each surface 113, 115 includes a flange 119 to permit inner post to be attached to members 14 and 14' of units 10 and 10' respectively. Inner post 111 includes a lower section 121, which has an upper surface 123 for forming the top of the concrete footing, and also includes a pair of perpendicular surfaces 125, 127, which form the inside corner of the concrete footing.

Outer post 109 is preferably formed from a section of steel tubing having a generally square cross section as is commonly available. Outer post 109 includes a lower section 129, which includes an upper surface 131 and a pair of mutually perpendicular lower surfaces 133, 135. Surface 131 forms the top surface of the concrete footing, while surfaces 133, 135 form the outside corner of the concrete footing. Outer post 109 includes a plurality of attachment holes 137 to permit post 109 to be connected to extenders 116 and 117. Finally, outer post 109 includes a plurality of enlarged access holes 139, which permit the installer to gain access to the attachment bolts 141 used to connect outer post 109 to the adjacent extenders 116, 117.

As shown in FIGS. 5 and 5*a*, each of the extenders 116, 117 includes an upper edge 120, a lower edge 122, and a pair of side edges 124, 126. Side edges 124, 126 include a plurality of bolt holes 128 to permit edges 124, 126 to be positioned between outer post 109 and unit 110 or 110', respectively. Each member 116, 117 includes a wall forming section 130 and a footing forming section 132. Wall section 130 includes a planar concrete forming surface 134, while footing section 132 includes an upper forming surface 136 and a lower forming surface 138. Surface 134 is preferably perpendicular to surface 136, and surface 136 is preferably perpendicular to surface 138. Upper surface 136 of footing section 132 includes a plurality of bolt holes 140 which register with bolt holes 142 on the lower edge of wall section 130 to permit wall section 130 and footing section 132 to be bolted together using a plurality of attachment bolts 144. Lower edge 122 of each member 116, 117 includes a ground panel 146 which extends outwardly away from and perpendicular to surface 138. Ground panel 146 includes a bottom surface 148 for placement on a support surface such as the ground, and also includes a top surface 150 for receiving sand, backfill or other ballast. The wall forming section 130 of each member 116, 117 includes a frame 152. Frame 152 includes upper and lower ribs 154, 156 and a pair of side ribs 158, 160. A horizontally extending reinforcing rib 162 extends from rib 158 to rib 160. A wall panel 160, which is preferably a steel plate, is welded or otherwise secured to frame 152.

As shown in FIG. 5, outer post 109 may alternatively include a transit mounting plate 170 which is secured to the upper end of outer post 109. Mounting plate 170 includes central mounting hole 172 for attaching a digital transit 174 to post 109. Transit 174, which is commonly employed in t he surveying and construction industries, is used to ensure that members 110 and 110' are perpendicular to each other. Transit 174 can be positioned at each corner of the foundation wall to ensure that the framework will be square.

It is understood that the above description does not limit the invention to the above-given details, but may be modified within the scope of the following claims.

What is claimed:

1. An apparatus for forming a concrete foundation wall having an integral footing, the apparatus comprising:

a pair of opposing spaced apart form members, said form members defining a concrete receiving cavity therebetween, said cavity including a footing area of rectangular cross section;

each of said form members including a concrete forming surface defined between an upper edge, a lower edge, and interconnecting side edges;

attachment means secured to each of said form members and extending across said cavity for attaching said spaced apart form members to each other to form an integrated unit, said attachment means including stabilizing means for preventing relative movement between said spaced apart members so that said integrated unit can be moved as a single structure, said attachment means further including a releasable fastener serving to permit said form members to be separated from each other and stripped from the wall after concrete has been poured into said cavity;

said lower edge including a horizontally extending ground panel, said ground panel extending outwardly away from said cavity parallel and adjacent to a support surface, so that when ballast is placed on said ground panel and concrete is poured into said cavity the weight of the ballast against said panel prevents said unit from moving upwardly away from the support surface.

2. An apparatus for forming a concrete foundation wall having an integral footing, the apparatus comprising:

a pair of opposing spaced apart form members, said form members defining a concrete receiving cavity therebetween, said cavity including a footing area of rectangular cross section;

each of said form members including a concrete forming surface defined between an upper edge, a lower edge, and interconnecting side edges;

attachment means secured to each of said form members and extending across said cavity for attaching said spaced apart form members to each other to form an integrated unit, said attachment means including stabilizing means for preventing relative movement between said spaced apart members so that said integrated unit can be moved as a single structure, said attachment means further including a releasable fastener serving to permit said form members to be separated from each other and stripped from the wall after concrete has been poured into said cavity;

said concrete forming surface including a wall panel and upper and lower footing panels, said upper footing panel extending from and perpendicular to said wall panel and said lower footing panel extending from and perpendicular to said upper footing panel, said lower footing panel forming said member lower edge.

3. A The apparatus of claim 2, including a ground panel extending outwardly from said lower footing panel, said ground panel extending outwardly away from said cavity parallel and adjacent to a support surface, so that when ballast is placed on said ground panel and concrete is poured into said cavity the weight of the ballast against said lower floating panel prevents said unit from moving upwardly away from the support surface.

4. A concrete foundation wall forming apparatus capable of being moved as a unitary structure comprising;

a pair of opposing spaced apart form members, said form members defining a concrete receiving cavity therebetween, said cavity including a footing area of rectangular cross-section;

each of said form members including a concrete forming surface bounded by an upper edge, a lower edge, and interconnecting side edges;

a plurality of attachment members for attaching said spaced apart form members to each other to form an integrated unit, said attachment members being secured to each of said form members and extending through said cavity, said attachment members including stabilizing means for preventing relative movement between said spaced apart form members upon movement of said structure, said attachment members further including a releasable fastener to permit said form members to be separated from each other after concrete has been poured into said cavity;

said lower edge including a horizontally extending ground panel, said ground panel extending outwardly away from said cavity parallel and adjacent to a support surface, so that when ballast is placed on said ground panel and concrete is poured into said cavity the weight of the ballast against said panel prevents said unit from moving upwardly away from the support surface.

5. A concrete foundation wall forming apparatus capable of being moved as a unitary structure comprising;

a pair of opposing spaced apart form members, said form members defining a concrete receiving cavity therebetween, said cavity including a footing area of rectangular cross-section;

each of said form members including a concrete forming surface bounded by an upper edge, a lower edge, and interconnecting side edges;

a plurality of attachment members for attaching said spaced apart form members to each other to form an integrated unit, said attachment members being secured to each of said form members and extending through said cavity, said attachment members including stabilizing means for preventing relative movement between said spaced apart form members upon movement of said structure, said attachment members further including a releasable fastener to permit said form members to be separated from each other after concrete has been poured into said cavity;

said concrete forming surface including a wall panel and upper and lower footing panels, said upper footing panel extending from and perpendicular to said wall panel and said lower footing panel extending from and perpendicular to said upper footing panel, said lower footing panel forming said member lower edge.

* * * * *